United States Patent [19]

Lopata

[11] 4,301,665

[45] Nov. 24, 1981

Best Available Copy

[54] SEALING ARRANGEMENT

[75] Inventor: Karl P. Lopata, Krefeld, Fed. Rep. of Germany

[73] Assignee: Kleinewefers GmbH, Krefeld, Fed. Rep. of Germany

[21] Appl. No.: 209,655

[22] Filed: Nov. 24, 1980

Related U.S. Application Data

[63] Continuation of Ser. No. 19,883, Mar. 12, 1979, abandoned.

[30] Foreign Application Priority Data

Mar. 11, 1978 [DE] Fed. Rep. of Germany ..... 2810660
Apr. 26, 1978 [DE] Fed. Rep. of Germany ..... 2818178

[51] Int. Cl.[3] ..... D06B 23/18
[52] U.S. Cl. ..... 68/5 E; 34/242
[58] Field of Search ..... 68/5 E; 34/242

[56] References Cited

U.S. PATENT DOCUMENTS 3,048,992 8/1962 Nakaguchi ..... 68/5 E
3,328,982 7/1967 Mylo ..... 68/5 E
3,808,845 5/1974 Lopata ..... 68/5 E
3,939,576 2/1976 Lawrence ..... 68/5 E X

FOREIGN PATENT DOCUMENTS 1127314 4/1962 Fed. Rep. of Germany ..... 68/5 E
46-9867 3/1971 Japan ..... 68/5 E

*Primary Examiner*—Philip R. Coe
*Attorney, Agent, or Firm*—Becker & Becker, Inc.

[57] ABSTRACT

A sealing arrangement for the inlet and outlet opening of a vessel for continuous treatment, under pressure, of a textile web which is passed over at least one roller within the vessel is disclosed. The sealing arrangement includes at least one seal element having endwise faces which are in contact with side members of a pair of oppositely disposed side members, which in turn are secured to lateral walls of the vessel, each of the side members being in sealing contact with the roller and the adjacent walls of the vessel. The side members are composed of a resiliently compressible material of construction which can be resiliently compressed at least in the direction of extension of the longitudinal central axis of the roller. The seal element is carried by a retaining bar, which has ends which are in sealing contact with the side members. The retaining bar is sealingly engageable with a traverse member extending along a longitudinal edge of the vessel opening.

18 Claims, 12 Drawing Figures

Fig. 4
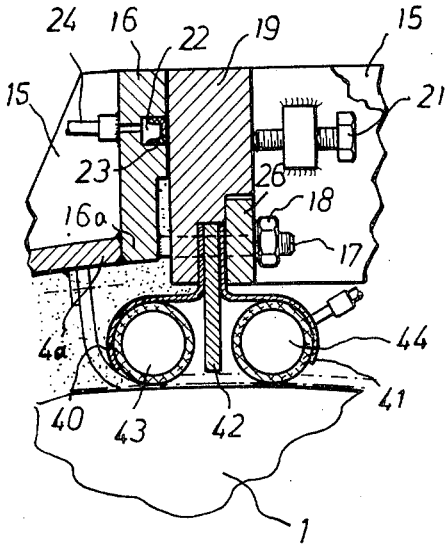
Fig. 5
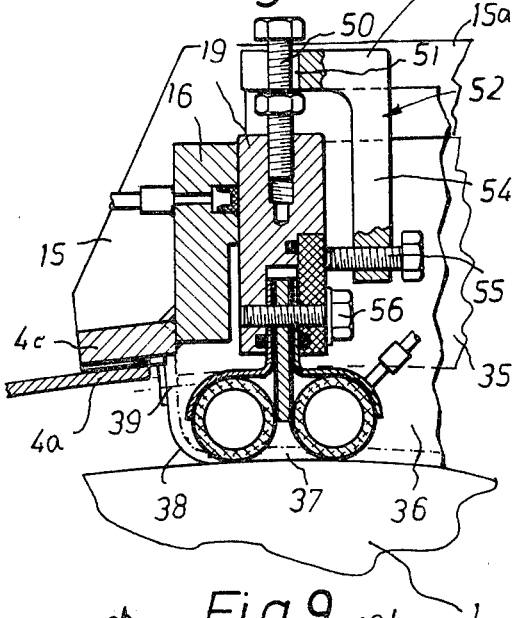
Fig. 9
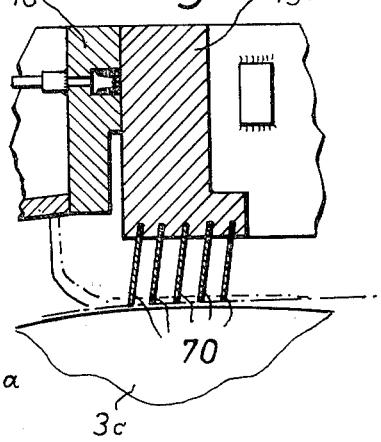
Fig. 10a
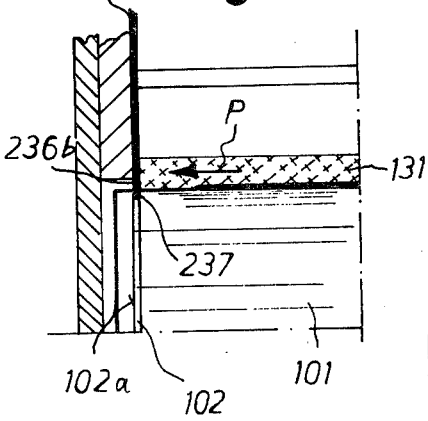
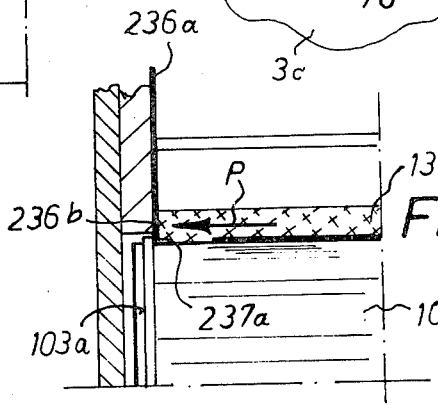
Fig. 10b

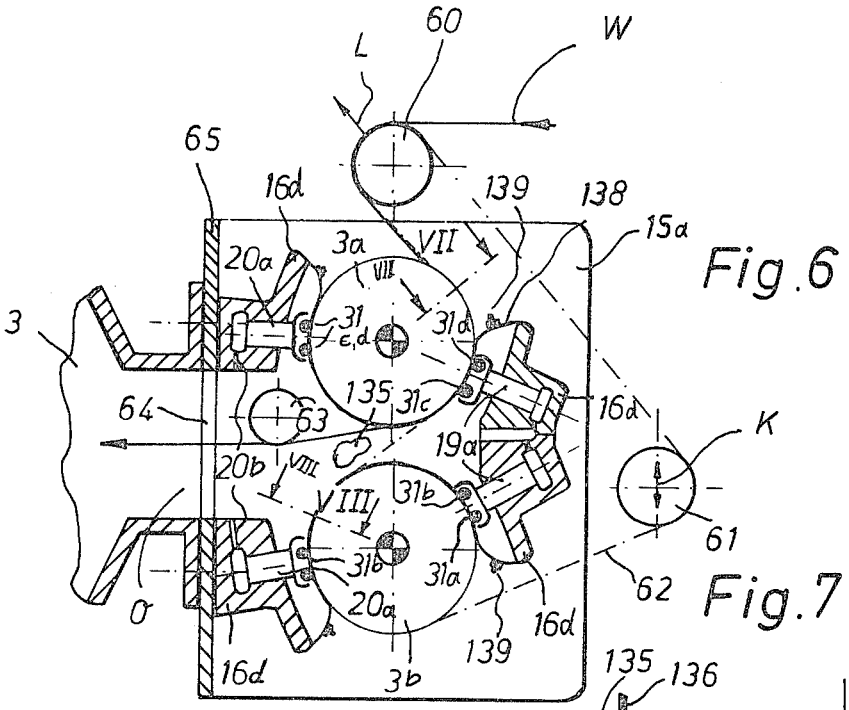
Fig. 6
Fig. 7
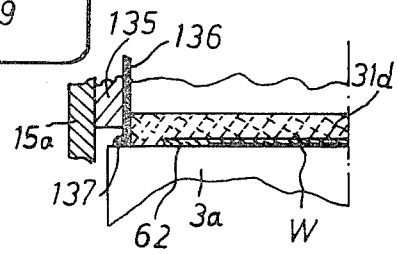
Fig. 8a
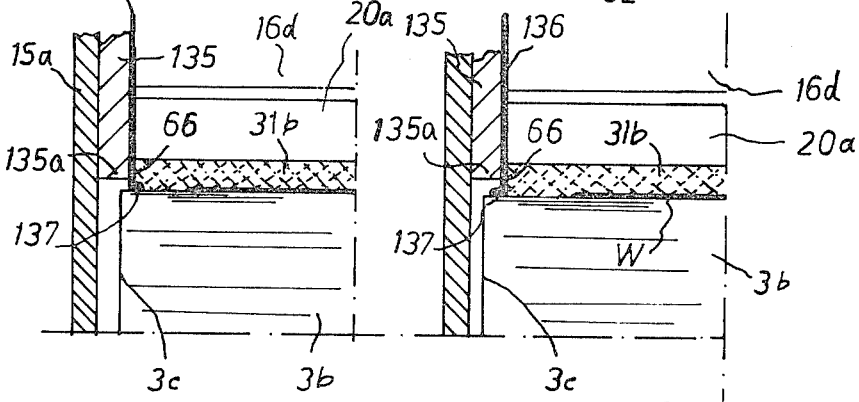
Fig. 8b

SEALING ARRANGEMENT

This application is a continuation of application Ser. No. 19,883, filed Mar. 12, 1979, and now abandoned.

The present invention relates to a sealing arrangement for the inlet and exit opening of a vessel maintained under positive or negative pressure, or similar container, for the continuous treatment of a textile web guided over at least one roller in the vessel interior, with at least one longitudinal sealing element extending transversely to the direction of movement of, and in contact with, the textile web, whereby the endwise faces of the sealing element are in contact with side members, which, in turn, are in sealing contact with the roller ends and respective vessel walls.

The sealing arrangement is applicable both at the inlet and exit opening of such containers wherein the contained atmosphere is different from the ambient, for example, a distinct gaseous atmosphere, or wherein the temperature of the medium within the vessel or container is distinct from the temperature of the ambient. Preferably, the sealing arrangement is applicable to vessels for treating textile webs by application of negative pressure and wherein the temperature conditions are up to 300° C.

U.S. Pat. No. 3,048,992 Nakaguchi issued Aug. 14, 1962 discloses a seal installation, for the container inlet and container outlet, comprising two gate rollers and an intermediate roller disposed in the gap between the gate rollers for contacting the gate roller, with the textile web being interposed. The end faces of the rollers are disposed in a rectangular frame which is resiliently pressed against the two gate rollers by springs. This installation is only useful for vessels operating under overpressure, since the rollers are not provided with axle extensions. Furthermore, the effective seal at the right-angled corners of the rectangular frame is not sufficient, as will be appreciated by a person skilled in the art.

There is furthermore known a seal for the inlet and exit ports of a high pressure steamer, damper, or similar unit, comprising pressure medium containing hoses or tubes. For precise sealing of the sealing rollers and the sealing elements which extend parallel to the sealing rollers, cylinder piston units are provided which press the sealing shield against the end faces of the rollers and the ends of the sealing elements. With this proposal, a secure sealing against the roller end faces and against the seal can be obtained, however, only at the expense of considerable technical effort of the cylinder piston units.

It is an object of the present invention to provide a sealing arrangement which affords a very simple, secure and durable sealing of the seal components with respect to the roller and the textile web in contact therewith, and with respect to the container walls, even when the seal components are moved radially against the rollers or away from the rollers to regulate the sealing pressure.

This object and other objects and advantages of the invention will appear more clearly from the following specification in connection with the accompanying drawings, in which:

FIGS. 4, 5 and 9 show other embodiments of the sealing arrangement of the invention similar to the view in FIG. 2;

FIG. 6 shows a vertical section of yet another embodiment of the sealing arrangement according to the invention;

FIG. 7 shows the section along lines VII—VII in FIG. 6 for the application in a pressure vessel;

FIGS. 8*a* and 8*b* show sections along line VIII—VIII of FIG. 6 of two slightly modified embodiments; and FIGS. 10*a* and 10*b* show modifications of the sealing arrangement at the drum ends.

In accordance with one aspect of the present invention, it is contemplated that the seal side members, which are secured to the container or vessel walls, are comprised of a material which can be resiliently compressed in axial and radial directions of a roller within the vessel. It is also contemplated that the seal element is held by a retaining bar provided at a distance away from the roller, whereby the ends of the sealing element are in sealing contact with the resiliently compressible side members. It is further contemplated that one of the longitudinal sides of the retaining bar is sealed with respect to a traverse member provided at one of the longitudinal edges of the vessel opening.

The sealing arrangement in accordance with the invention provides the advantage that by a very simple means the endwise sealing of the sealing elements which face the roller will be achieved substantially independently of radial sealing between a sealing element and the textile web and the roller. The arrangement can be utilized in underpressure or overpressure vessels.

Figure 1:
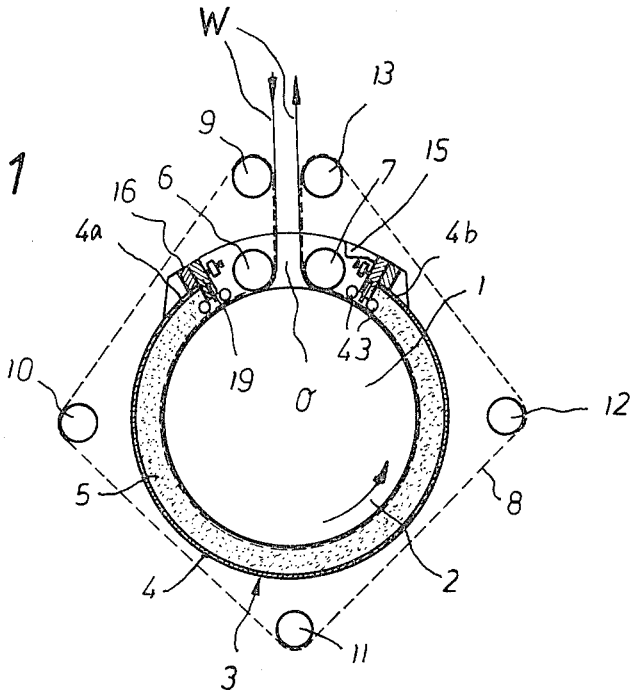
FIG. 1 is a diagrammatic representation, in vertical section, of a first embodiment of the sealing arrangement in accordance with the invention.

Referring now particularly to the drawings, in FIG. 1 a roller or rotary drum 1 is shown which can rotate in the direction of arrow 2 in a container or vessel 3 having a cylindrical surface 4 which approximately concentrically surrounds the drum 1 over its entire surface. The vessel also has two side walls 5 of which only one can be seen in FIG. 3 of the drawings.

The ends 4*a* and 4*b* (FIG. 1) of the cylindrical surface 4 of the vessel 3 are located at a distance from each other and form between them the inlet and outlet opening "O" of the vessel 3.

Furthermore, inlet and exit rollers 6 and 7 are journalled at the two ends 4*a* and 4*b* of surface 4. A textile web "W" is passed over rollers 6 and 7 prior to coming into contact, or after being in contact, with the surface of drum 1 which drum is a roller which rotates about a longitudinal axis.

An endless pressure band 8, shown in dash lines in FIG. 1, can be provided for particular treatment purposes, e.g., when it is important that the textile web "W" is in close contact with the drum 1. The pressure band 8 is passed over the deflector rolls 9, 10, 11, 12, and 13, and is then passed over rollers 6 and 7 together with the textile web "W".

In accordance with one aspect of the invention, the region between the surface of drum 1 and the cylindrical surface 4, adjacent ends 4*a* and 4*b*, and, as well, between the end walls of roller 1 and the two associated side walls 5 of vessel 3, is to be sealed to form an enclosure against the outer or ambient atmosphere.

Figure 2:
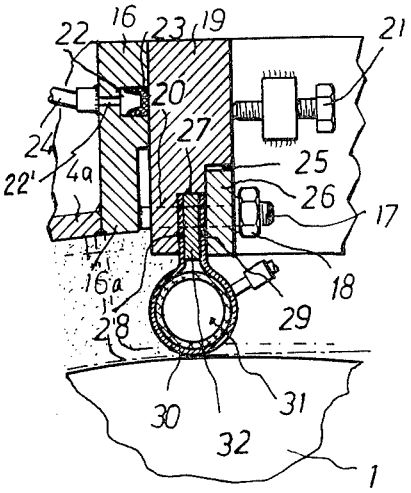
FIG. 2 is a side view, partly in section, of the traverse member and a retaining bar with the sealing elements secured thereto.

For this purpose, the side walls 5 of vessel 3 include side wall or lateral face wall pieces 15, and rollers 6 and 7 can be journalled by these side wall pieces 15. Between the oppositely arranged side wall pieces 15, the distance between which is in conformity with the distance between the side walls 5 of the vessel 3, traverse girders or holding bar members 16 are arranged, which are secured to the ends 4*a* and 4*b* of the surface 4, whereby the lateral ends of the girders or holding members 16 are sealingly connected to the side wall pieces 15. The lower portions 16*a* (FIGS. 2 and 4) of the girders or holding members 16 are sealingly secured to the ends 4*a* and 4*b* of the surface 4, for example, by welding.

The lower portion 16*a* of a traverse member 16 comprises a row of threaded studs 17 which extend into the opening "O", whereby the threaded studs 17 of oppositely facing traverse members 16 are approximately in line with each other. A retaining bar 19 is held on the corresponding traverse member 16 by the threaded studs 17 which extend through bores 20 in the retaining bar 19, and nuts 18. The contact pressure between the joined components is adjustable by means of pressure control screws 21. A longitudinal groove 22 is provided in the upper portion of a traverse member 16. The open side of groove 22 faces the retaining bar 19 and is filled with a sealing strip 23 with a U-shaped cross-sectional profile. Groove 22 is in communication with a pneumatic pressure source, not shown, by means of conduit 24 and suitable bores 22'.

Figure 3:
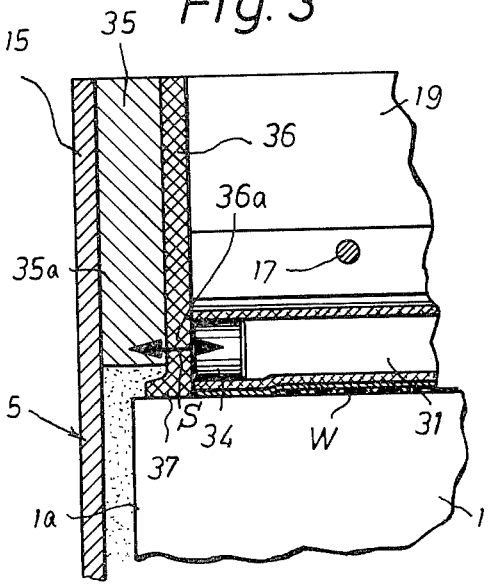
FIG. 3 shows a vertical section of a side wall, a retaining bar, a side member piece, as well as a spacer member.

A bar 26, which is positioned in a longitudinal cutout 25 at the underside of a retaining bar 19, is also retained by the threaded studs 17 and nuts 18. In accordance with the embodiment shown in FIG. 2, on bar 26, and on the oppositely extending wall of a further cutout 27, there rest the edges 28 and 29 of a foil 30 of a sealing tube or hose 31 to which a pressure medium is supplied by the intervention of a valve, not shown. The ends of the tubular sealing hose 31 are closed by plugs 34 (FIG. 3).

A flat spacer member 35 is provided on the respective interior surfaces of the side wall pieces 15. The spacer members 35 extend from the upper edge (FIG. 3) to approximately the height of the sealing hose 31, as well as between the two retaining bars 19. A segmental side member 36 is provided, and suitably secured, on the spacer member 35. For lateral sealing, side member 36 is composed of an elastically deformable sealing material. The thickness of a spacer member 35 is selected such that the lower edge of the side member 36, which includes a reinforcing bead 37, is resiliently and sealingly in engagement with the edge 1*a* of drum 1 (FIG. 3). The lower portion 36*a* of the sealing side member 36 is in contact, and sealingly compressible in the direction of the double-headed arrow S, FIG. 3, with a respective end of the sealing element in the form of a hose 31 and closed by the plug 34, while simultaneously, resiliently and sealingly engaging the drum 1, whereby resilient sealing is achieved also between the retaining bar 19 and the intermediate and upper portion of the side member 36. As shown in FIG. 5, the segmental sealing side member 36 has lateral curves 38 which, in turn, merge with straight sections 39. The ends of straight sections 39 are sealingly secured to the ends 4*a* and 4*b*, or attached to a traverse piece 4*c* secured thereon. The lower portion of the side member 36, thus, has approximately the shape of a skid runner with endwise curves 38.

In the embodiment according to FIG. 4, a foil, such as foil 30, as described previously, now eliminated. The upstanding ends of two rim-forming elements 40 and 41 are clamped between the retaining bars 26 and the lower part of a retaining bar 19. A spacer member 42 is provided between elements 40 and 41. The rim-forming elements 40 and 41 each hold a tube 43 and 44 which tubes are also suitably connected to a source for supplying pneumatic pressure, not shown, and the ends thereof are also closed by plugs, for example, formed of a soft rubber with a suitable surface.

In the embodiment according to FIG. 5, the retaining bar 19 is radially adjustable by way of respect to drum 1 with adjustment screws 50. The screws 50 extend through spaced-apart bores 51 in angle bracket 52. The upper, horizontal leg 53 of angle bracket 52 is connected to an upwardly directed extension 15*a* of the side all piece 15. The lower, downwardly directed leg 54 of angle bracket 52 extends between the side member 36 and carries the screws 55 with which the retaining bar 19 can be pressed against the traverse member 16. The rim-forming elements 40 and 41 are held between the bars 19 and 26 by screw 56.

FIGS. 6 to 8*b* show an embodiment wherein a pressure band covers the textile web "W" only during entry and exit from the overpressure or underpressure vessel. The textile web "W" is not covered by the band in the vessel. According to FIG. 6, which shows the sealing arrangement at the vessel inlet, two rollers 3*a* and 3*b* are journalled and provided between the two side wall pieces 15*a*, at the same height and symmetrically with respect to the opening "O". Parallel to the rollers 3*a* and 3*b* which are driven together there is provided a deflector roll 60 which is movable in the direction of arrow "L". Deflector roll 60 is associated with a second deflector roll 61 which is movable in the direction of the double headed arrow "K". The pressure band 62 which is passed over the two rolls 60 and 61 and the two rollers 3*a* and 3*b*, has a width which is only slightly less than that of the rollers 3*a* and 3*b* and rolls 60 and 61, the latter two rolls being of equal length. The pressure band 62 is gas-tight and, if required, heat insulating. The band 62 surrounds the rollers 3*a* through approximately the same angle as the textile web "W". The textile web "W" is passed over the deflector roll 60 and in contact with the upper surface of roller 3*a*, whereby it is pressed against roller 3*a* by the pressure band 62. The textile web "W" surrounds the roller 3*a* through an angle of approximately 150° and is then passed to a further roll 63 and the interior of the vessel 3.

The band 62 has a width which is greater than the width of the textile web "W" to be treated. The lateral additional width of the pressure band 62 with respect to the edges of the textile web "W" is at least 10 mm. Thus, over the distance corresponding to the contact arc of the textile web "W" on the roller 3*a*, the textile web "W" is covered by the pressure band 62 and sheathed by the band and the upper surface of roller 3*a*. This will avoid uneven blowing or wedging of the textile web "W" on entry into the vessel 3, which is maintained under steam pressure, for example, when the textile web "W" is pretreated in a dyeing step.

Four sealing elements 31*a*, 31*b*, 31*c*, 31*d* are provided for sealing of the rollers 3*a* and 3*b*. On each of the two side wall pieces 15*a*, between which the rollers 3*a* and 3*b* are journalled, there are arranged oppositely facing spacer members 135, which extend between the sealing elements 31*a*–31*d* and about the rollers 3*a* and 3*b* up to the opening 64 of the flange 65. As is indicated in FIG. 8*a*, which shows a sealing arrangement for a vessel maintained under overpressure (whereas FIG. 8*b* shows a sealing arrangement for a vessel under underpressure), the rim 135*a* of the spacer member 135 extends close to the upper surface of the rollers 3*a* and 3*b*, while the rollers extend with their respective end faces 3*c* to be in proximity with the spacer members 135.

A traverse member 16*d* extends between the spacer members 135, parallel to the rollers 3*a* and 3*b*, for each sealing element 31*a*–31*d*. Each of the traverse members 16*d* adjacent the opening "O" of the vessel 3 is provided with retaining bars 20*a* while the traverse members 16*d* adjacent second deflector roll 61 are associated with retaining bars 19*a*. The retaining bars 20*a*, when the vessel is an overpressure vessel, can communicate, via channel 20*b*, with the interior of the vessel 3. Instead of hydraulic adjustment means, the retaining bars 19*a* and 20*a* can include mechanical adjustment means by means of which the sealing elements 31*a*–31*d*, in the form of sealing ducts or beadings, of retaining bars 19*a* and 20*a*, are pressable against the rollers 3*a*, 3*b* and pressure band 62. The tubular sealing elements 31*a*–31*d*, which can also be in the form of solid rubber, or similar means (FIGS. 7 to 8*b*), are in contact, with their respective end faces, with rubber-elastic segmental side member 136 which extends beyond the spacer member 135. The foot end 137 of the rubber-elastic seal side member 136 is elastically and sealingly in contact with the rollers 3*a* and 3*b* whereby the adjacent section of the side member 136 is compressed, simultaneously elastically and sealingly, between the end faces 66 of the seal elements 31*a*–31*d* and the adjacent edge 135*a* of the spacer member 135. The foot end, or the reinforcing bead 137, of the rubber-elastic side member 136 can be secured at edge 138 of spacer member 135 (FIG. 6) by screws 139 (FIG. 6) as has been described in context with the embodiments of FIGS. 1 to 5.

FIG. 7 shows a section along line VII—VII in FIG. 6 and indicates that the pressure band 62 laterally exceeds the width of the textile web "W" on the roller 3*a* by about 10 mm, whereby the pressure band 62 is pressed against the rollers 3*a* and 3*b* by the seal elements 31*a*–31*d*.

In all embodiments described, instead of tubular sealing elements or sealing beadings, there may be utilized chamber-like or spaced-apart elastic sealing strips or similar means which provide for sealing between the rollers 1, 3*a*, 3*b*, the retaining bars 19 and 19*a* and the side members 36 and 136. Such an embodiment is shown in FIG. 9, wherein the elastic sealing strips 70 are in contact with roller 3*c* and are carried by retaining bar 19*b* which is secured to the transverse member 16*b*.

In the embodiment according to FIGS. 10*a* and 10*b*, the tubular sealing elements 131 can exert a considerable amount of axial pressure in the direction of the arrows "P", without deforming the lower edges 237 and 237*a* of the elastically deformable side members 236 and 236*a*, so as to render the lower edges incapable of sealing the rollers 101 and 101*a*. For this purpose, the roller 101, according to FIG. 10*a*, is provided with a groove 102 sealingly into which extends the edge 237 of the side member 236. Edge 237 can be pressed against the face wall 102*a* of the groove 102 when pressure is exerted, in the direction of the arrow "P", on the free portion 236*b* of the side members 236 and 236*a*.

In the embodiment according to FIG. 10*b*, a bead 103*a* is provided instead of the groove 102. Edge 237*a* can be brought to bear against the wall 103*a* whereby, again, proper sealing contact of the edge on the surface of the roller 101*a* is achieved.

It is, of course, to be understood that the present invention is in no way limited to the specific disclosure and showing in the drawings, but also encompasses any modifications within the scope of the appended claims.

What I claim is:

1. An apparatus for continuous treatment of a textile web at an atmospheric pressure different from ambient pressure, the apparatus comprising, in combination:

a vessel having an inner surface for defining a wall of an enclosure having the different pressure;

a rotatable roller having a surface forming another wall of the enclosure;

means for rotating the roller about a longitudinal axis;

means for holding the web in contact with the roller to advance the web through the enclosure as the roller rotates; and, a sealing arrangement, comprising:

at least one retaining member extending longitudinally along the roller in spaced relation thereto to form a passage for the enclosure through which passage the web passes;

at least one longitudinal seal element mounted on the retaining member and extending longitudinally along the roller, said seal element engaging the web as the web is advanced by the roller through the enclosure and said seal element sealing the passage of the enclosure;

a pair of side walls spaced from the ends of the roller and ends of the retaining member and forming end walls of the enclosure;

spacers extending inwardly from the end walls for holding the end walls spaced from the end of the roller, and sealing gaskets positioned between and abutted by the spacers and retaining members and extending radially of the roller, said sealing gaskets engaging the surface of the roller outboard of the ends of the seal element while being held in engagement with the ends of the seal elements by the spacers.

2. The apparatus of claim 1 wherein the sealing arrangement includes a pair of said retaining members each of which has one of said seal elements mounted thereon, wherein the retaining members and thus the seal elements thereon are spaced from one another, and wherein the passage formed by one seal element is an inlet passage into the enclosure for the web and the passage formed by the other seal element is an outlet passage from the enclosure for the web.

3. An apparatus in accordance with claim 1, wherein the seal element comprises:

a sealing duct having first and second ends; and plug means for closing said first and second ends of said sealing duct, said plug means forming sealing contact with the sealing gaskets.

4. An apparatus in accordance with claim 1, wherein the retaining member is radially adjustable with respect to said roller.

5. An apparatus in accordance with claim 1, wherein said apparatus further comprises:

a pair of guide rollers, each of said guide rollers extending in the direction of the longitudinal axis of said rotatable roller and being spaced from the seal element, and at least one of said rollers being within said vessel.

6. An apparatus in accordance with claim 5, wherein a girder member with a longitudinal groove extends between said side walls, parallel to, and radially away from said rollers.

7. An apparatus in accordance with claim 6, wherein said retaining member extends substantially parallel to said girder member and further comprises:

a pressure-controllable longitudinal seal, sealingly disposed between facing side walls of said retaining member and said girder member.

8. An apparatus in accordance with claim 7, wherein said pressure-controllable seal includes a U-shaped cross-sectional profile seal member disposed in the longitudinal groove in said girder member.

9. An apparatus in accordance with claim 7, wherein said pressure-controllable seal includes a tubular seal disposed in the longitudinal groove in said girder member.

10. An apparatus in accordance with claim 5, wherein a girder member extends between said side walls and is sealingly secured to the side walls.

11. An apparatus in accordance with claim 10, wherein said girder member is sealingly secured to a flanged neck defining a vessel opening.

12. An apparatus in accordance with claim 1, including two of said spacers and four seal elements for said roller and said guide rollers.

13. An apparatus in accordance with claim 1, wherein said means for rotating the roller includes:

a pressure band overlying in part said textile web for pressing said textile web against said roller, said pressure band having a sufficient width so as to exceed that of said textile web by at least 10 mm beyond web edges; and a guide roller contacted by said pressure band.

14. An apparatus in accordance with claim 13, wherein said pressure band is gas tight.

15. An apparatus in accordance with claim 13, wherein said pressure band is heat insulating.

16. An apparatus in accordance with claim 1, wherein each end of said roller includes a circumferential groove for receiving therein the inner edge of the adjoining gasket.

17. An apparatus in accordance with claim 1, wherein each end of said roller carries a circumferential protrusion for sealingly engaging the adjoining gasket.

18. A sealing arrangement in accordance with claim 1, wherein the seal element comprises:

a sealing area of parallel seal strips.

* * * * *